US010309745B2

(12) United States Patent
Messinger

(10) Patent No.: US 10,309,745 B2
(45) Date of Patent: Jun. 4, 2019

(54) MOBILE TURRET WEAPON DELIVERY SYSTEM

(71) Applicant: Samuel Messinger, Ramot Beit Shemesh Gimmel (IL)

(72) Inventor: Samuel Messinger, Ramot Beit Shemesh Gimmel (IL)

( * ) Notice: Subject to any disclaimer, the term of this patent is extended or adjusted under 35 U.S.C. 154(b) by 0 days.

(21) Appl. No.: 16/181,572

(22) Filed: Nov. 6, 2018

(65) Prior Publication Data

US 2019/0137208 A1 May 9, 2019

Related U.S. Application Data

(60) Provisional application No. 62/583,514, filed on Nov. 9, 2017.

(51) Int. Cl.
*F41A 27/18* (2006.01)
*F41G 1/38* (2006.01)
*F41G 1/40* (2006.01)

(52) U.S. Cl.
CPC ..... *F41A 27/18* (2013.01); *F41G 1/38* (2013.01); *F41G 1/40* (2013.01)

(58) Field of Classification Search
CPC ..... F41A 27/18; F41A 27/00; F41A 27/02; F41A 27/06; F41A 27/08; F41A 27/10; F41A 27/14; F41A 27/16; F41A 27/20; F41A 27/30; F41G 1/38; F41G 1/40
USPC ..... 89/41.01, 36.13, 36.14, 36.15, 37.01, 89/37.03, 41.02, 41.09, 41.11, 4.16, 89/41.17, 41.19, 37.21, 40.01, 40.06; 42/118, 136
See application file for complete search history.

(56) References Cited

U.S. PATENT DOCUMENTS 362,900 A * 5/1887 Nordenfelt ..... F41A 23/12 89/40.06
694,904 A * 3/1902 Youlten ..... F41G 1/40 356/254
1,184,078 A * 5/1916 Cooke ..... F41G 1/40 42/118
1,195,055 A * 8/1916 McNeal ..... F41G 1/40 42/118
1,260,285 A * 3/1918 Cordell ..... F41G 1/40 356/254
1,269,178 A * 6/1918 Hamilton ..... F41G 1/40 356/254

(Continued)

*Primary Examiner* — John Cooper

(57) ABSTRACT

This invention relates to mobile turret adapted for use with lightweight semi-automatic or automatic weapons, said mobile turret comprising: a foldable base platform, wherein said foldable base platform comprises a seat and a tripod; a collapsible turret arrangement, wherein collapsible turret arrangement comprises a plurality of lever systems for adjusting the height, a first handle control, a second handle control, a rod connector, a trigger connector, and a reload magazine slide; an expandable periscope, wherein said expandable periscope comprises movable tube part for adjusting the height of said expandable periscope; and a holster in which different light weight semi-automatic or automatic weapon can be attached. The mobile turret has many advantages such as easy to carry, light weight, quickly assembled/operable, the operator can hide behind the protection or in the trenches, and will increase firepower to overwhelm and destroy the enemy.

14 Claims, 19 Drawing Sheets

(56) References Cited

U.S. PATENT DOCUMENTS

| | | | | | |
|---|---|---|---|---|---|
| 1,300,688 | A * | 4/1919 | Bellard | F41G 1/40 | 42/118 |
| 2,137,577 | A * | 11/1938 | Lobelle | F41A 23/20 | 89/37.16 |
| 2,627,132 | A * | 2/1953 | Dolgacius | F41G 1/40 | 356/254 |
| 2,764,915 | A * | 10/1956 | Weiss | F41A 27/22 | 89/40.01 |
| 4,878,305 | A * | 11/1989 | Gabrielidis | F41A 19/09 | 42/72 |
| D398,035 | S * | 9/1998 | Rowe | D22/100 | |
| 7,137,220 | B1 * | 11/2006 | Bradley, Jr. | F41G 1/40 | 42/119 |
| 8,393,258 | B2 * | 3/2013 | Cazalieres | F41A 23/20 | 89/1.804 |
| 8,640,374 | B1 * | 2/2014 | Reichelt | F41C 27/00 | 42/106 |
| 9,097,477 | B1 * | 8/2015 | Mead | F41A 9/26 | |
| 9,581,400 | B2 * | 2/2017 | Dove | F41A 9/01 | |
| 9,759,505 | B2 * | 9/2017 | Al Abdouli | F41A 19/64 | |
| 2010/0175547 | A1 * | 7/2010 | Hoffman | F41A 7/08 | 89/9 |
| 2014/0223791 | A1 * | 8/2014 | Ruby | F41C 27/00 | 42/49.01 |
| 2015/0068098 | A1 * | 3/2015 | Stokes | F41G 1/48 | 42/118 |

* cited by examiner

MOBILE TURRET WEAPON DELIVERY SYSTEM

FIELD OF THE INVENTION

The present invention generally relates to the field of weapon delivery system.

The invention, particularly relates to a light weight mobile turret adapted for use with a light eight semi-automatic or automatic weapon and further the mobile turret is easily and quickly foldable and expandable.

BACKGROUND OF THE INVENTION

A gun turret is a location from which weapons can be fired that affords protection, visibility, and some cone of fire. A modern gun turret is generally a weapon mount that houses the crew or mechanism of a projectile-firing weapon and at the same time lets the weapon be aimed and fired in some degree of azimuth and elevation (cone of fire). Rotating turrets can be mounted on a fortified building or structure such as a coastal blockhouse, be part of a land battery, be mounted on a combat vehicle, a naval ship, or a military aircraft, they may be armed with one or more machine guns, automatic cannons, large-caliber guns, or missile launchers. They may be manned or remotely controlled and are most often protected to some degree, if not actually armored. The protection provided by the turret may be against battle damage, the weather conditions, general environment in which the weapon or its crew will be operating. The name derives from the pre-existing noun turret meaning a self-contained protective position which is situated on top of a fortification or defensive wall as opposed to rising directly from the ground, in which case it constitutes a tower. A small turret, or sub-turret set on top of a larger one, is called a cupola. The term cupola is also used for a rotating turret that carries a sighting device rather than weaponry, such as that used by a tank commander.

In the present world the inventions and the development in the field of weaponry is growing paralleling with the development of the other fields of warfare technology. Public discussion on weapons at the present time centers around nuclear warheads and delivery. However, those with day to day responsibility to evaluate threats to national security always come back to the basics of "boots on the ground" combatant soldiers. The need for use of weapons such as AK47, M16, 7 mm hand gun, stand gun, sniper, Barrett REC7 carbine are not diminished as the foot soldier. is needed as never before. This often entails face to face, hand to hand contact with direct engagement. The major challenges to mobility appear when the combatant needs to carry a weapon with the other accessories since present battle zone engagement requires the soldier to often be mobile and flexible. 6tfc6xAlso, weapons are mostly fired in an erect position and have limited fire power. During this engagement while firing at the enemy the combatant exposes his torso as a target opportunity for the enemy combatant.

A large number of rifles, shotguns, muzzleloaders, military firearms, etc. were and are manufactured equipped only with open sights, also called iron sights. These rifles may be subsequently fitted with optical sights such as riflescopes, reflex, and holographic sights, which are needed to look directly through them. However rifles if equipped with periscopes have the distinct advantage of identifying the enemy target without exposing the combatant's body. One method for sighting-in involves attaching the periscope with the rifle, and then centering the elevation and lateral aim point of the rifle with the laser.

A number of different type of the tools and methods for advanced lightweight or heavyweight gun equipped with periscope are available in prior art. Prior art document, CN2179569 discloses a gun periscope firing device for protecting oneself used in war which is composed of a support bracket, a fastener, a trigger driving head, a periscope, an optical sighting device, a focal length regulating knob, a gunstock, a left handle, a trigger and a right handle. The person in the trench observes the periscope and sights via an optical sight, the accurate and efficient enemy killing is implemented, and the furthest oneself protection is achieved.

Another prior art, CN102735104 discloses a method and device of firearm capable of carrying out periscopic shooting, which is formed by a gun body, a periscope, a linkage box and a gun support. The linkage box is movably connected at the lower end of the gun body. The lower end of the linkage box is fixedly connected with the gun support. The periscope is arranged at the rear end of the linkage box and the inner part of the linkage box is provided with a pulley. If the linkage trigger is hinged in the linkage box, and the gun trigger is connected with the linkage trigger by the cord pull rounding the pulley and the gun shot out.

Yet another prior art, U.S. Pat. No. 3,545,837 discloses a launching device in which an optical sight is coupled to the mounting of a launching device to direct the launching device before to the launch of a missile. Disconnect means is provided so that the mounting can be oriented in a direction other than that dictated by the sight, after the missile is launched.

Yet another prior art, U.S. Pat. No. 1,184,078 discloses a method for designed, arranged and especially well adapted to meet defensive requirements of trench warfare, the arm proper being directly mounted upon an elongated magazine of large capacity, which in turn is adjustably mounted upon a supporting rod or pike, thus providing for trenches of varying depths, and further equipped with a suitable periscope by means of which latter the gun may be sighted without exposing an in trenched operator to fire of the enemy.

Yet another prior art, U.S. Pat. No. 1,260,285 discloses a periscope attachment for rifles. In another prior art, U.S. Pat. No. 4,336,743 discloses a gun mount for light automatic weapons, comprising an upper mount having cradle means for the detachable attachment of the weapon thereto and a lower mount having a circular track and being adapted to be attached to a vehicle in such a manner that the upper mount is rotated about the vertical axis of the circular track. The cradle is pivotable about a horizontal weapon traverse axis. Aiming means comprising a rigid periscope having fixed reflecting mirrors is provided with its eyepiece located below the circular track and whose sight radius is coupled with the traverse motion of the weapon about the weapon traverse axis.

Yet another prior art, U.S. Pat. No. 3,954,041 discloses an observation post such as a turret having an observation opening allowing passage of the head of an operator there through, the opening being preferably closable by an armored hatch cover. An external viewing device is mounted outside the turret and is employed by the operator with his head disposed in the observation opening, and an internal viewing device is mounted inside the turret below the external viewing device and parallel thereto, the internal viewing device being of greater precision and having a reduced field of view as compared to the external viewing device.

Yet another prior art, U.S. Pat. No. 1,322,124 discloses a, machine by means of which a gun such as a rifle, machine gun, or the like, can be supported at the upper end of a vertical supporting structure, at a distance above the operator, by means of which said gun can be selectively manipulated, aimed and fired by the operator from his position below, thus providing a machine by means of which a man in a trench, or behind other protection, can manipulate and effectively use a rifle, or machine gun, supported at a distance above, without exposing himself to the fire of the enemy.

Yet another prior art, U.S. Pat. No. 2,366,410 discloses a method to provide in a gun emplacement especially suited for use on aircraft a gun pivotally mounted for purpose 'of aiming, and a unsighted associated with the gun which will enable the gunner to occupy a position other than one in which his line of vision is aligned with the axis of a sighting means secured to and moving with the gun.

Yet another prior art, DE1196098 discloses a mount for light weapons, particularly machine guns, in connection with which there is cut at a suitable place in the roof of an armored vehicle a hole into which there is inserted a flange having a rotatable cylindrical sleeve. A periscopic telescopic sight and a system of rods for turning and tilting the mount are arranged in the cylindrical sleeve. The system of rods is developed in the manner of a parallelogram guide so that the movement of the telescopic sight takes place synchronously with the movement of the mount and therefore of the machine gun. The commencement of the firing is effected by means of a Bowden cable which is connected with the trigger of the machine gun. The viewing opening of the telescopic tube lies at such a large distance from the roof that a gunner seated in the vehicle and covered by the armoring of the vehicle can, in a normal seated position, observe the surroundings and possibly affect the aiming and firing.

However, above mentioned references and many other similar references has one or more of the following shortcomings: (a) fixed position; (b) heavy weight; (c) can't fold the accessories; (d) not easy to handle; (e) not all the parts are operable; (f) ammo clips or magazines which hold only 30 to 60 bullets and inefficiency to change ammo clips or magazines; (g) turrets are attached with the tank; and (h) exposing soldier to enemy fire.

The present application addresses the above-mentioned concerns and short comings with regard to providing a lightweight mobile turret with rapid ammo clip changer.

SUMMARY OF THE INVENTION

In the view of the foregoing disadvantages inherent in the known types of accessories of gun turret now present in the prior art, the present invention provides an improved accessory for gun turret. As such, the general purpose of the present invention, which will be described subsequently in greater detail, is to provide a new and improved mobile turret which has all the advantages of the prior art and none of the disadvantages.

An object of the invention is to provide a mobile turret adapted for use with a light weight semi-automatic or automatic weapon, said mobile turret comprising: a foldable base platform, wherein said foldable base platform comprises a seat and a tripod; a collapsible turret arrangement, wherein collapsible turret arrangement comprises a plurality of level systems for adjusting the height, a first handle control, a second handle control, a rod connector, a trigger connector, and a reload magazine slide; an expandable periscope, wherein said expandable periscope comprises movable tube part for adjusting the height of said expandable periscope; and a holster in which different light weight semi-automatic or automatic weapon can be attached.

Another object of the present invention is to provide the mobile turret, wherein said foldable base platform comprises said tripod with which said collapsible turret arrangement is connected.

Yet another object of the present invention is to provide the mobile turret, wherein said expandable periscope is clamped with said collapsible turret arrangement.

Yet another object of the present invention is to provide the mobile turret, wherein said trigger connector at the bottom is connected to the trigger of the weapon at the top for firing.

Yet another object of the present invention is to provide the mobile turret, wherein said second handle control is for controlling the elevation of the weapon.

Yet another object of the present invention is to provide the mobile turret, wherein reload magazine slide comprises carousel filled with magazines or ammo clips.

Yet another object of the present invention is to provide the mobile turret, wherein said rod connector is for rejecting the used magazines from the weapon.

Yet another object of the present invention is to provide the mobile turret, wherein said first handle control used to adjust the level/height of said collapsible turret arrangement.

Yet another object of the present invention is to provide the mobile turret, wherein said mobile turret having said expandable periscope can be used either in trenches or behind other protection such as walls to protect the operator from the enemy fire.

Yet another object of the present invention is to provide the mobile turret, wherein said mobile turret is foldable and collapsible and can be easily carried by the operator on the shoulder like backpack. Its estimated weight is 3.3 kg to 5.2 kg depending on materials used in construction for lightweight weapons application.

Yet another object of the present invention is to provide the mobile turret, wherein reload magazine slide can be move up and down and used to load quickly new magazines to the weapon which increases weapon capacity to fire more rounds in a minute.

Yet another object of the present invention is to provide the mobile turret, wherein said mobile turret can also be used for shoulder fired rocket launchers and bazookas.

Yet another object of the present invention is to provide the mobile turret, wherein said expandable periscope has ranger finder and is calibrated with the laser of weapon to target enemy.

Yet another object of the present invention is to provide the mobile turret, wherein said mobile turret has GPS linked command center.

Yet another object of the present invention is to provide the mobile turret, wherein said expandable periscope has display terrain, night vision and infrared.

Yet another object of the present invention is to provide the mobile turret, wherein a composite of several said mobile turrets screens broadcast to command head quarter wirelessly which helps to create a map of the battlefield for efficient use of infantry.

According to an embodiment of the invention a portable turret for supporting, aiming and firing a weapon includes a base and a vertical support rotatably supported by the base. A weapon mounting fixture is pivotably mounted on an upper end of the vertical support. The weapon mounting fixture is adapted to receive and secure the weapon at an upper end of the vertical support. A first handle attached to the vertical support is adapted to rotate the vertical support relative to the base to adjust an azimuthal firing angle of the weapon. A second handle, also attached to the vertical support forms a pistol grip that includes a secondary trigger. A trigger linkage extends between the secondary trigger and a primary trigger associated with the weapon, such that a pulling movement of the secondary trigger mechanically causes a corresponding pulling movement of the primary trigger to fire the weapon. An altitude firing angle adjustment lever associated with the second handle is provided for adjusting the altitude firing angle of the weapon. An altitude firing angle adjustment link extends between the altitude firing angle adjustment lever and a connection point on a rearward portion of the weapon mounting fixture, such that upward and downward movement of the altitude firing angle adjustment lever causes the weapon mounting fixture to pivot forward and back atop the vertical support, thereby altering the altitude firing angle of the weapon secured within the weapon mounting fixture. A magazine re-load lever associated with the weapon mounting fixture provided for ejecting a spent magazine from the weapon. A magazine reload slide is slidably attached to the vertical support. The magazine reload slide includes a magazine compartment adapted to receive and hold an ammunition magazine, the magazine compartment is oriented such that a magazine placed in the magazine compartment may be received by and loaded into the weapon by an upward sliding movement of the magazine reload slide. Finally, a periscope is mounted on the vertical support. The periscope includes an image acquiring aperture mounted substantially adjacent the weapon mounting fixture. A periscope eyepiece is mounted substantially adjacent the second handle. A telescoping optical tube extends between the image acquiring aperture and the eyepiece. The base of the portable turret comprises a collapsible tripod. A collapsible seat may be foldably attached to the tripod. 3. The portable turret of claim 2 further comprising a collapsible seat foldably attached to the tripod.

According to another embodiment of the invention, a mobile turret allows a soldier to fire a weapon from a protected firing position on a battle field. According to this embodiment the mobile turret includes a base and a vertical support rotatably mounted to the base. The vertical support has an adjustable length with an upper end. A weapon holster is pivotably mounted on the upper end of the vertical support. The weapon holster is adapted to receive and support the weapon. A secondary trigger lever is attached to the vertical support between the base and the upper end of the vertical support. A mechanical trigger linkage extends between the secondary trigger lever and a primary trigger associated with the weapon supported by the weapon holster. The mechanical trigger linkage is configured such that when the soldier pulls the secondary trigger, the trigger linkage mechanically pulls the primary trigger, thereby firing the weapon. A first lever handle is attached to the vertical support. The first lever is adapted to rotate the vertical support along with the weapon holster mounted thereon to adjust an azimuthal firing angle of the weapon. A second lever handle is also attached to the vertical support. An altitude firing angle adjustment linkage is connected between the second lever handle and the weapon holster. Upward and downward movement of the second lever handle causes the weapon holster to pivot forward and back atop vertical support to adjust the altitude firing angle of the weapon supported by the weapon holster.

A magazine ejection linkage is provided to allow the soldier to remotely eject an ammunition magazine from the weapon. A magazine reload slide is slidably mounted on the vertical support. the magazine reload slide is adapted to store a spare ammunition magazine for reloading the weapon. The magazine reload slide stores the spare magazine in a position such that the spare magazine may be loaded directly into the weapon by manually sliding the reload slide upward along the vertical support. With this arrangement a soldier may aim, fire and reload the weapon form a protected position below the firing position of the weapon supported by the weapon holster atop the vertical support.

According to yet another embodiment of the invention, a mobile weapon support system allows a weapon to be mounted in a position above a protective barrier. A soldier head taking cover behind the protective barrier may remotely aim, fire and reload the weapon mounted above the soldier's head. The mobile weapon support system includes an adjustable height rotating turret. A weapon holster is pivotably mounted atop the rotating turret. A weapon may be secured in the weapon holster. A first handle is provided for rotating the turret to adjust an azimuthal firing angle of the weapon. An altitude firing angle adjustment lever is provided for adjusting an altitude firing angle of the weapon. An altitude firing angle adjustment rod extends between the altitude firing angle lever and the holster such that upward and downward motion of the altitude firing angle lever is translated into forward and back pivoting motion of the holster atop the rotatable turret, thereby altering the altitude firing angle of the weapon secured within the holster. A mechanical trigger linkage is provided between a remote secondary trigger lever a primary trigger associated with the weapon so that the soldier may fire the weapon by pulling the secondary trigger lever. A magazine ejection linkage is provided for ejecting a spent ammunition magazine from the weapon. A slidable magazine loader is adapted to load an ammunition magazine into the weapon. Finally, an adjustable length periscope is attached to the rotatable turret for providing a view of a battlefield in the direction in which the weapon is pointed to the soldier behind the protective barrier.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty which characterize the invention, are pointed out with particularity in the disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 13 to 17B depicts arrangement of the mobile turret how each segment is connected with the other according to one of the embodiment of the present invention. FIG. 13 shows the upper part of the mobile turret. The FIG. 14 shows a side view of the holster. FIGS. 17A and 17B shows a main base part of the tripod and the main collapsible turret arrangement in connected and unconnected positions.

DETAILED DESCRIPTION OF THE INVENTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined, or that other embodiments may be utilized and that structural and logical changes may be made without departing from the spirit and scope of the present invention. The following detailed description is, therefore, not to be taken in a limiting sense, and the scope of the present invention is defined by the appended claims and their equivalents.

According to the present invention the mobile turrets are movable, easy to install and uninstall. In modern combat the soldier use gun or rifle or other weapon to attack the enemy but to resist the attack from the enemy they don't have any shield or protecting cover. It leads to a weakening in the defense, loss of soldier as well as weapons in the war. Previously a mirror encased in a jury-rigged housing mounted to the rifle, the shooter could lift the rifle up over a trench, and looking through the periscope, fire it at a target without the shooter exposing themselves.

The use of periscope with the weapon to shoot has an advantage as the shooter can shoot without exposing their body to the enemy. The shooter can see and locate the exact location of the enemy and target the enemy. This may be enhanced with wireless adaptations to the periscope viewfinder.

The use of a seating arrangement for firing by lifting up with the rifle and other weapons by a rotatable shaft gives a reliable firing with aiming the target through the periscope. The arrangement for this must be movable so that the operator can move it anywhere on the battlefield according to their necessity.

Figure 1:
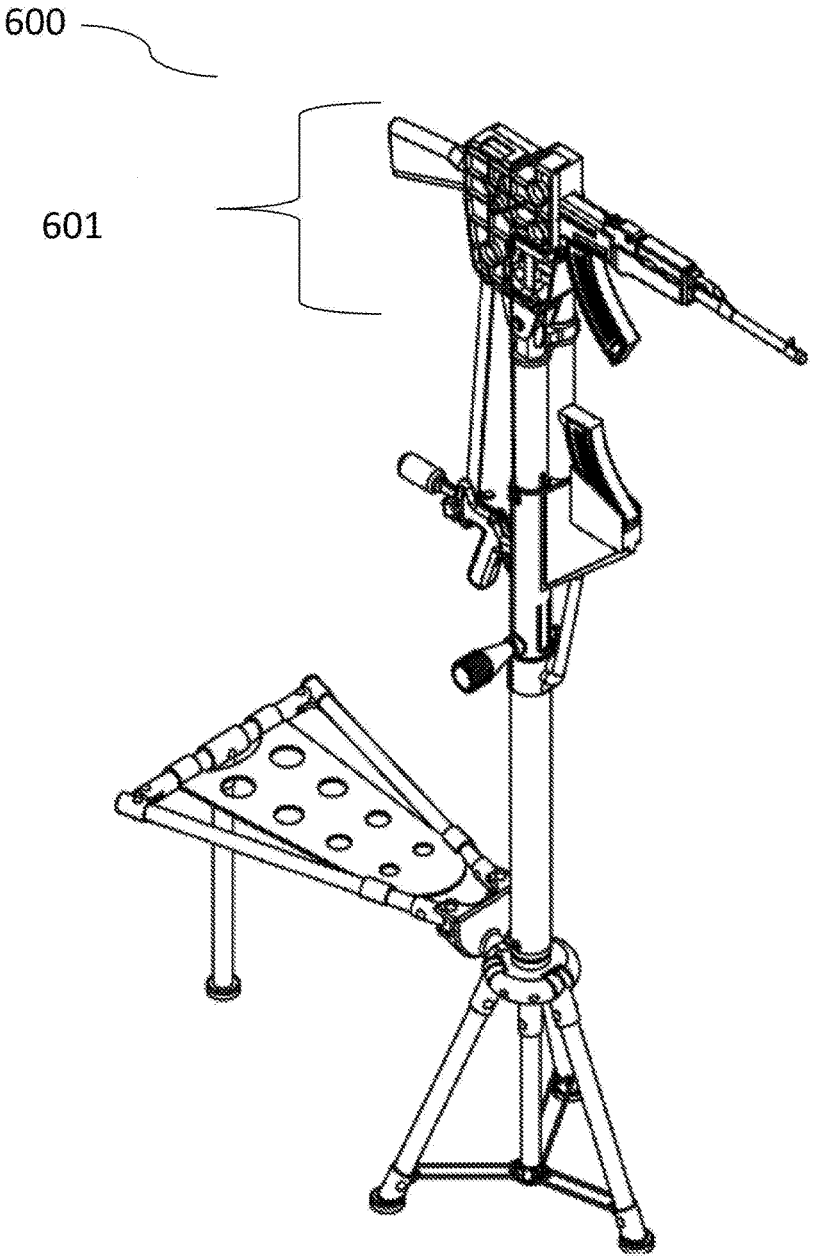
FIG. 1 depicts a perspective view of the mobile turret for use with a light weight semi-automatic or automatic weapon according to one of the embodiments of the present invention.
Figure 2A:
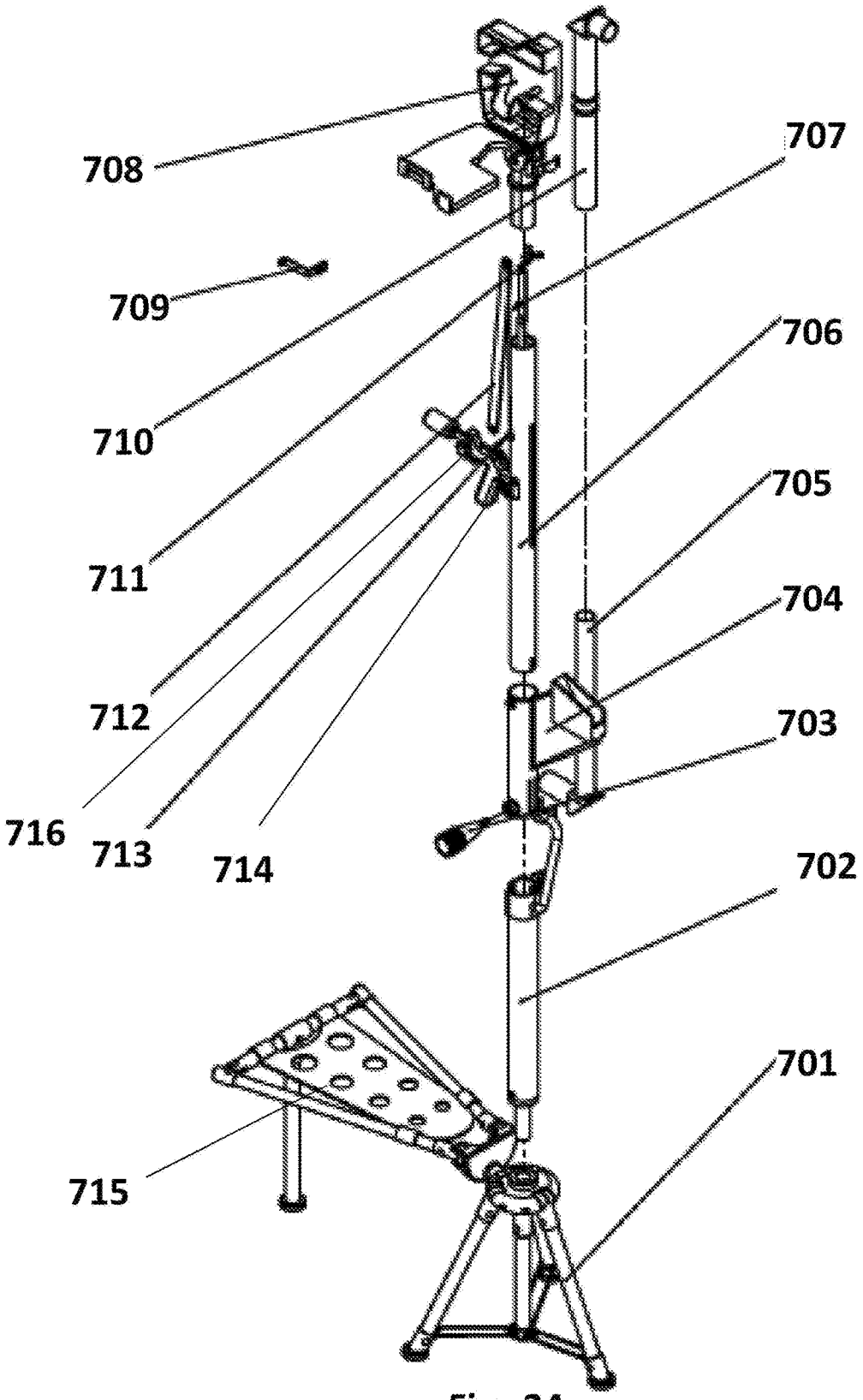
FIG. 2*a* depicts a various parts of the mobile turret according to one of the embodiments of the present invention.
Figure 2B:
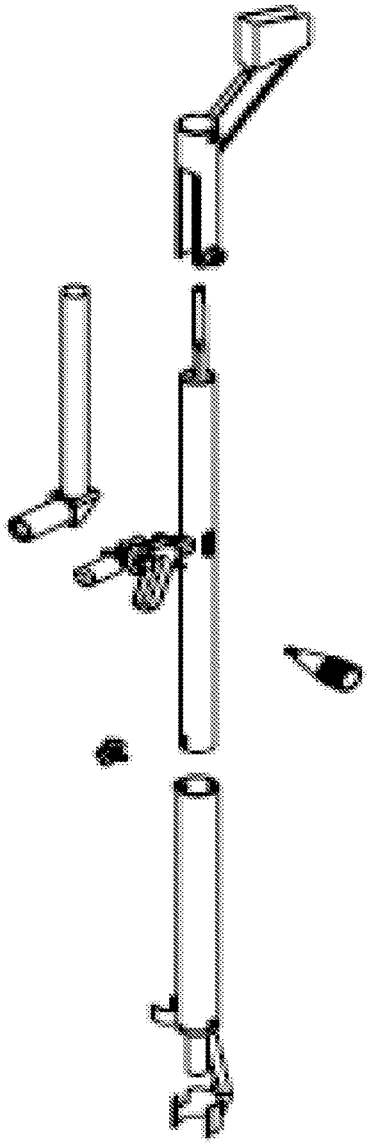
FIGS. 2B and 2C depicts a close up view of the various parts of the mobile turret according to one of the embodiments of the present invention.
Figure 2C:
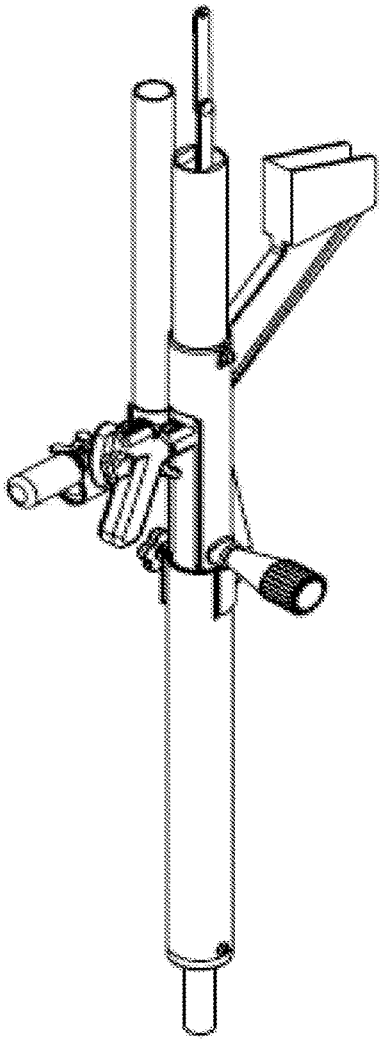

FIG. 1 shows a perspective view of the mobile turret 600 for use with a light weight semi-automatic or automatic weapon according to one of the embodiment of the present invention. FIG. 2*a* shows a various parts of the mobile turret 600 according to one of the embodiments of the present invention. FIGS. 2*b* and 2*c* depicts a close up view of the various parts of the mobile turret according to one of the embodiment of the present invention.

According to the one embodiment of the present invention a mobile turret 600 adapted for use with a light weight semi-automatic or automatic weapon. The operator (soldier combatant) in the battle field needs to fire at the enemy without exposing their own body. The mobile turret 600 comprises of a foldable base platform 603, a collapsible turret arrangement 602, an expandable periscope and a holster 601. The foldable base platform is further comprised of seat and a tripod. The collapsible turret arrangement further comprises a plurality of lever systems, a first handle control, a second handle control, a rod connector, a trigger connector, and a reload magazine slide. The expandable periscope comprises a movable tube part for adjusting the height of the expandable periscope.

The lower part of the present invention is a foldable base platform 603. The foldable base platform 603 in the present invention further comprises of a seat 715 and a tripod 701. The foldable base platform 603 is attached with collapsible turret arrangement 602. The tripod 701 in the present invention can be open wide or narrow to support the position of the mobile turret 600. The seat 715 in the present invention facilitate the operator to sit on the seat 715 which is connected to the tripod in one side and supported by one stand in another side of the seat 715.

One collapsible turret arrangement 602 is connected on the foldable base part 603. A collapsible turret arrangement 602 in the present invention comprise of a plurality of lever systems, such as lever system-1 702 and lever system-2 706, a first handle control 703, a second handle control 716, a rod connector 713, a trigger connector 714, and a reload magazine slide 704, fastening screw-1 707, fastening screw-2 711, a lever 712 and a reject lever 709. The lever system-1

702 is connected between the foldable base platform 603 and the lever system-2 706. The lever system-1 702 is fixed and rigid turret structure. The lever system-2 706 collapsible and removable turret structure. The lever system-2 706 is connected between the lever system-1 702 and the holster 601. The first handle control 703 is threaded and used for adjusting the lever/height of the collapsible turret arrangement. The first handle control 703 can also use for horizontal rotation of the mobile turret 600. The rotation of the mobile turret 600 can be clockwise or anti-clockwise and operator can also move the in 360 degree according to the necessity by using the first handle control 703.

The second handle control 716 is used to control the elevation of the weapon. The lever 712 is connected with the second handle control and the holster. When the operator pushes-up the second handle controls 716 the back part of the weapon moves upward forming a depression towards the ground. When the operator pulls-down the second handle control 716 the back part of the weapon moves downward. The reload magazine slide 704 is used to move up or down manually. The operator pushes up the reload magazine slide 704 to reload the weapon and pulls down the reload magazine slide to its original position. The reload magazine slide 704 comprises a carousel filled with magazines or ammo clips and reload magazine slide which can be moved up and down and used to load quickly new magazines to the weapon which increases weapon capacity to fire more rounds per minute. A rod connector 713 is connected for rejecting the used magazines from the weapon. One knob is connected at the end of the rod connector 713 to press the magazine catch. When the rod connector 713 presses the magazine catch the weapon reject the empty magazine. A trigger connector 714 of the bottom (with collapsible mobile turret arrangement) is connected to the trigger of the weapon at the top (in holster) for firing. The operator need to connect the entire component in a systematic manner and tightened by the plurality of screws such as fastening screw-1 707, fastening screw-2 711.

One holster 601 is connected on the collapsible turret arrangement 602 and the foldable base part 603. The holster 601 is a holder or a platform to hold the gun or put the gun firmly in one place. In our present invention the operator connects a lightweight weapon in the holster in the clamping gun system 708. Different lightweight semiautomatic or automatic weapon are attached in the holster. The automatic weapon such as FG 42, AK-47, M16 rifle and many more can be attach to the holster. The semi-automatic weapon such as L1A1 rifle, Walther WA 2000, Dragunov rifle etc. can be attach to the holster. The holster is mounted on the level system-2 706. The vertical movement of the holster is control by the vertical movement of the level system-2 706. The vertical movement of the level system-2 is control by the first handle control 703.

An expandable periscope is connected parallel with the collapsible turret arrangement. The expandable periscope comprises one movable part 710 and another is fixed part 705 for adjusting the height of the expandable periscope. The expandable periscope is clamped with the collapsible turret arrangement 602 as well in the holster. A plurality of clamps are fixed with the screws to the holster 601. The clamp is used to attach the periscope with the holster 601 in the mobile turret 600. The clamp is connected in such a way that the periscope is always in exact direction corresponding to the direction of the weapon and then using the levers centering the elevation and lateral coordinates to target the enemy. After configuring all the components of the mobile turret 600 the operator can see the enemy through the periscope. The operator connects the lightweight weapon in the holster in the clamping gun system 708. After tightening the all connection the mobile turret is ready to use for the operator combatant soldier. The operator can see the enemy and can adjust the weapon towards the target by watching through the expandable periscope and firing. The expandable periscope has ranger finder which is calibrated with the laser of the weapon to target enemy and the expandable periscope has display terrain, night vision and infrared. The height and the direction of the weapon and the expandable periscope can be adjusted by using the first handle control 703. The elevation of the expandable is controlled by the second handle control 716.

The expandable periscope in the mobile turret 600 can be used either in trenches or behind other protection to protect the operator from the enemy fire. The mobile turret 600 is designed in such a way that the operator can fire on the enemy by looking through a periscope. The mobile turret 600 in the present invention is foldable and collapsible and can be easily carried by the operator on the shoulder like backpack. The mobile turret 600 can also be used for shoulder fired weapons such as rocket launchers and bazookas. The mobile turret 600 has GPS linked to communicate with the command center. The plurality mobile turrets 600 screens and location broadcast to head quarter wirelessly which helps to create a map of the battlefield for efficient use of infantry and for future planning.

All the parts of the mobile turret 600 such as, the foldable base platform 603, the collapsible turret arrangement 602 and the expandable periscope and a holster 601 are foldable and collapsible. All the parts of the mobile turret 600 can be folded and collapsed by loosening the relevant rivet, pin and screw etc. The operator can fold up all the parts of the mobile turret 600 into a back pack into shoulder bag. The operator soldier combatant can carry the bag on the shoulder like a backpack.

Figure 3A:
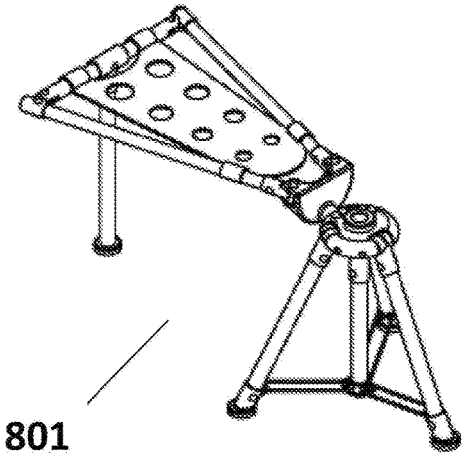
FIG. 3A depicts a close up view of the foldable base platform according to one of the embodiments of the present invention.
Figure 3B:
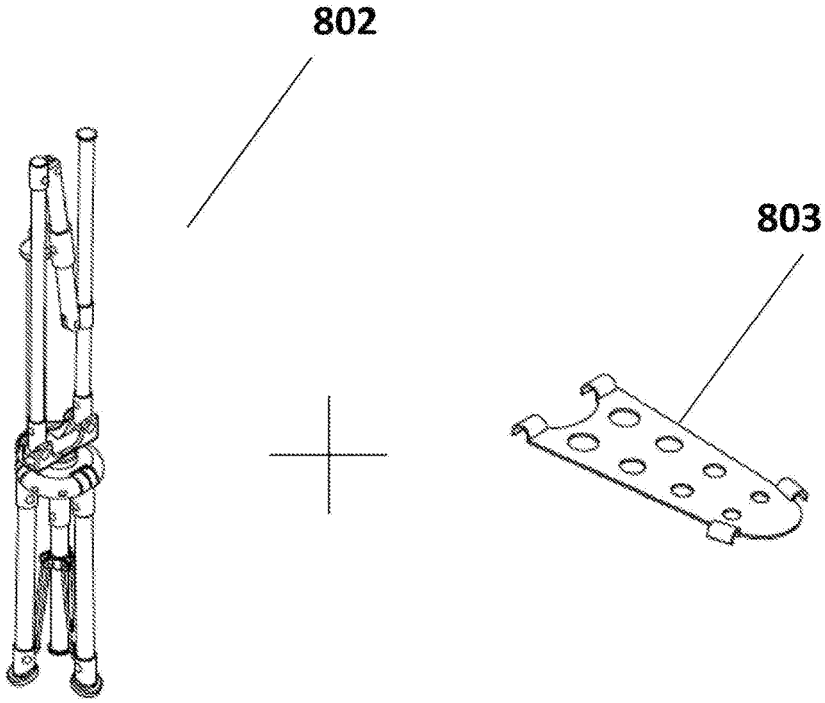
FIG. 3B depicts a close up view of the collapsible turret arrangement according to one of the embodiments of the present invention.

The FIGS. 3A-3C shows a close up view of the foldable base platform and collapsible turret arrangement according to one embodiment of the present invention. The base part of the present invention is a foldable base platform 801. The foldable base platform 801 in the present invention further comprises of a seat 803 and a tripod 802. The seat in the foldable base platform 801 further comprise of plurality of level, one back leg, seat plate, rivet and main base of the seat. The plurality of level comprise of back level and right level and left level. One back leg is connected to support the seat. The seat plate is connected with the plurality of level through clip. The pluralities of the level are connected through the rivet and form a structure where the seat plate can be fixed by using clip. The main base part of the seat is act as connector between the seat and the tripod. The tripod in the foldable base part 801 further comprise of plurality of leg, tube slide, leg joint, rivet, main base, and plurality of pin. The pluralities of leg are connected in the main base by using rivet and connect each other through leg joint. The tube slide is connected at the center of the tripod which is fixed by plurality of pin and connector slide and the stopper. The main base part of the tripod is connected to the main collapsible turret arrangement. The FIG. 3B shows the foldable base part after folding it. The leg joint in the tripod can slide up and down to close and open the pluralities of leg. In the foldable base part 802 the leg joint are slide up and the plurality of legs are closed. The back lever in the seat of the present invention can move through the other right lever and left lever. In the FIG. 3B the back lever it shows the back lever are folded by moving one end into the middle of either right lever and the left lever.

Figures 4A, 4B, 4C:
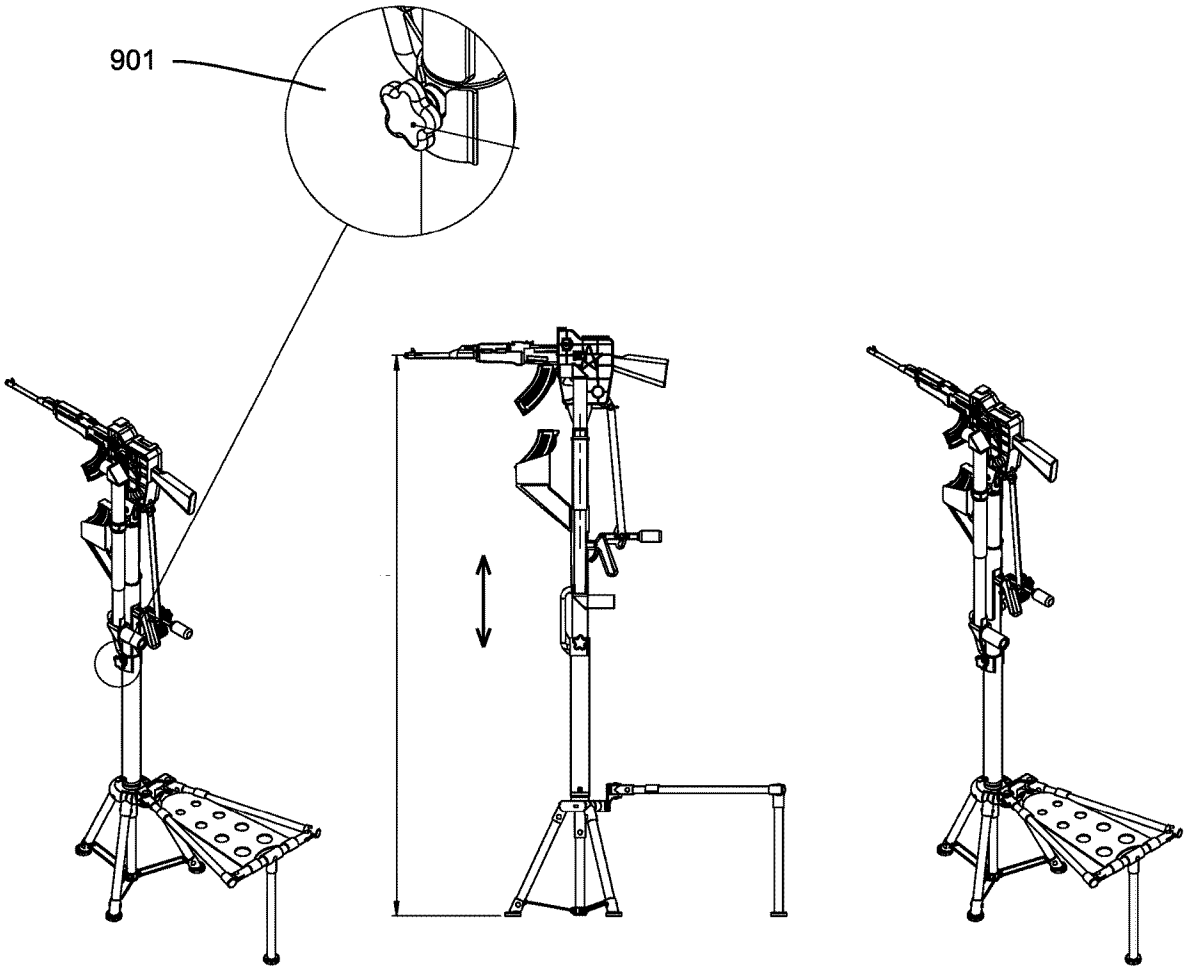
FIGS. 4A, 4B and 4C depicts the mobile turret of the present invention at various height adjustments.

The FIGS. 4A-4C shows height adjustments functioning of the mobile turret of the present invention. The first handle control 901 in the present invention is threaded and used for adjusting the level/height of the collapsible turret arrangement. The first handle control 901 further comprise of screw head and screw. The operator increases the height of the collapsible turret arrangement by moving the level system-2 manually e.g. by hand. The screw head is used to loose or tightened the level system-2 to adjust the height of the collapsible turret arrangement by rotating the screw. FIG. 4B and FIG. 4C side view and the front view of the mobile turret with the position of the first handle control 901. In the present invention the height of the collapsible turret arrangement can also increase or decrease by following mention method. The first handle control 901 can attach with the level system-1 which is fixed and connected with the level system-2 through a screw. When the screw head of the first handle control 901 rotates the screw which in turns rotates the screw which is attach with the level system-2.

Figure 5A:
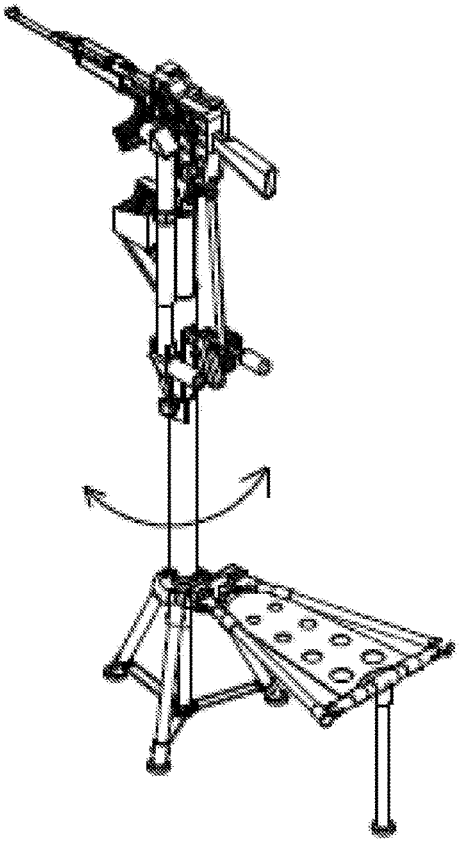
FIG. 5A is a side view illustration rotation adjustments functioning of the mobile turret of the present invention.
Figure 5B:
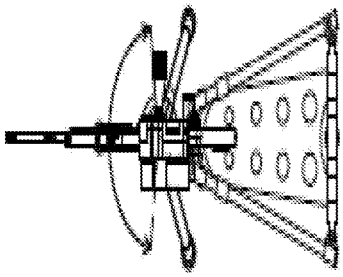
FIG. 5B is a top view illustration of the mobile turret of FIG. 5A.

According to the one of the embodiments in the present invention the mobile turret can rotate clockwise or anti-clockwise and operator can also move the mobile turret in 360 degree according to the necessity. The FIG. 5A and FIG. 5B shows rotation adjustments functioning of the mobile turret of the present invention. The first handle control use for horizontal rotation of the mobile turret. The operator can move the mobile turret manually also. The FIG. 5A shows a front view of the mobile turret and the FIG. 5B shows the top view of the mobile turret with horizontal rotation.

Figures 6A, 6B, 6C:
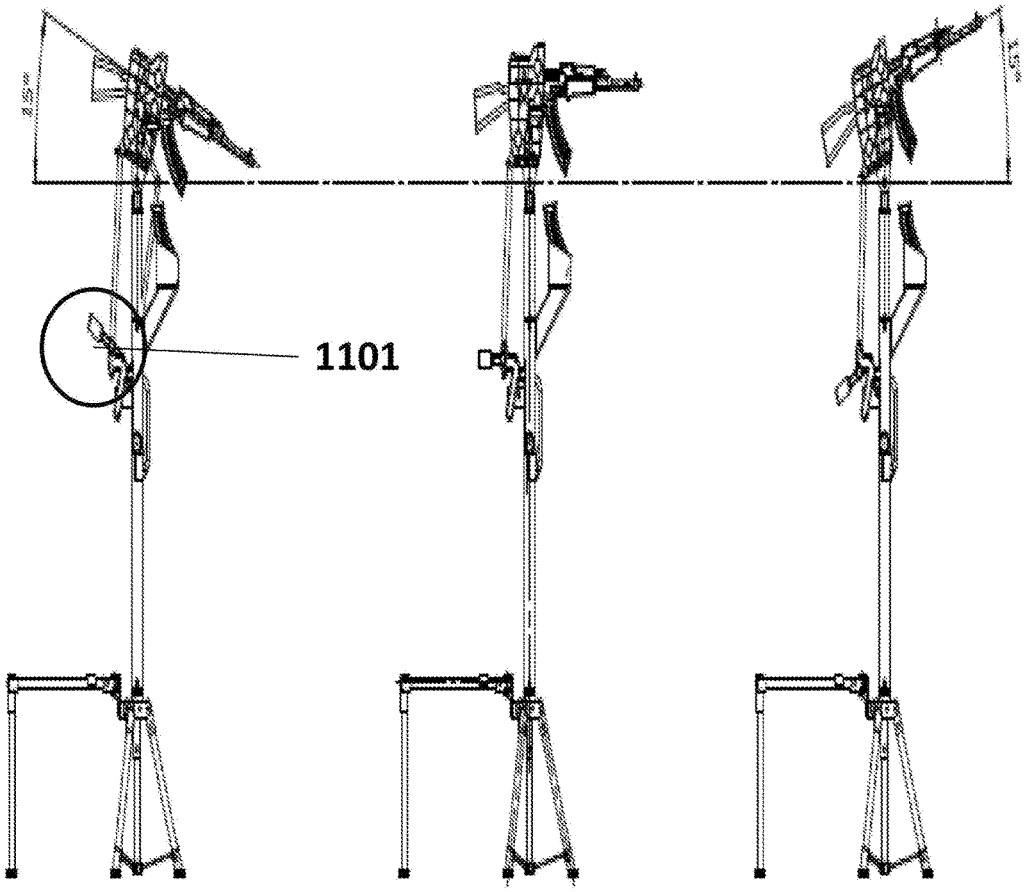
FIGS. 6A, 6B and 6C depict various barrel elevation adjustments of the mobile turret of the present invention.
Figure 7:
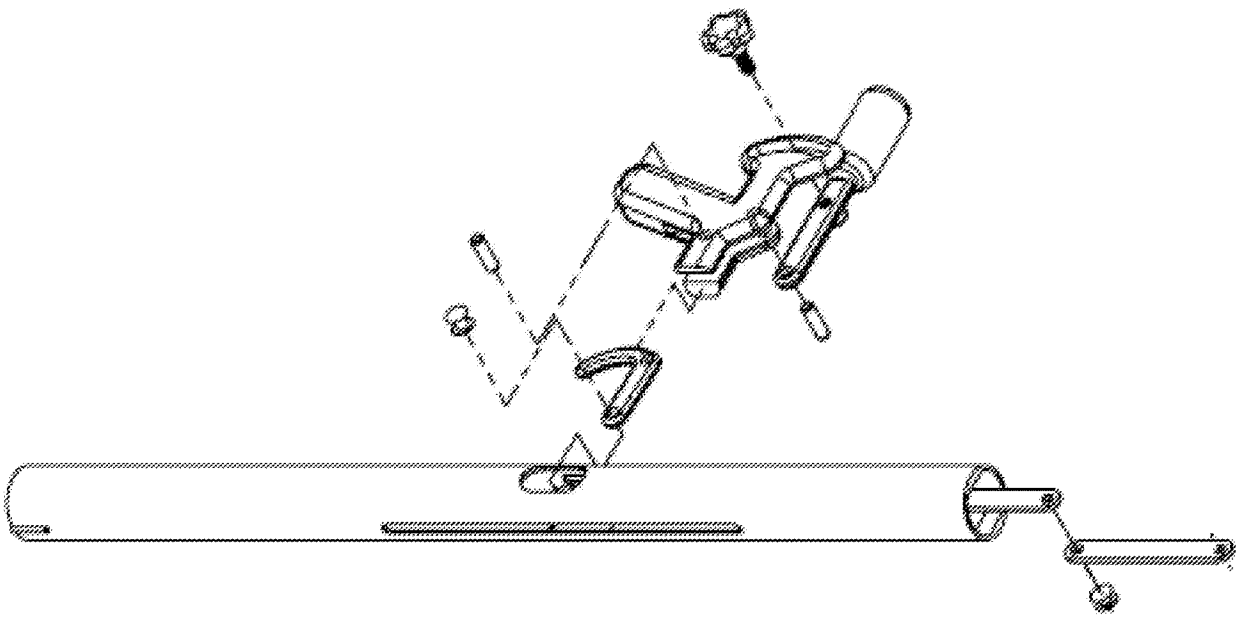
FIG. 7 depicts the close up view of the second handle control of the mobile turret arrangement.

In FIGS. 6A-6C shows the barrel elevation adjustments functioning of the mobile turret of the present invention. In the FIG. 6A, FIG. 6B and FIG. 6C, it shows one of the embodiments of this invention, one level is used to control the elevation of the weapon. The level is connected between second handle control 1101 and the holster in the present invention. The second handle control 1101 in the present invention can be pressed downward or push upward to adjust the elevation angle. When the operator need to fire nearby area then the operator pushed the second handle control 1101 upward and when the operator need to fire in a long distance then the operator pressed the second handle control 1101 downward. The angle of elevation or angle of depression is extended up to 150 only. FIG. 7 depicts the close up view of the second handle control 1101 and how it is connected with the mobile turret arrangement.

Figure 8A:
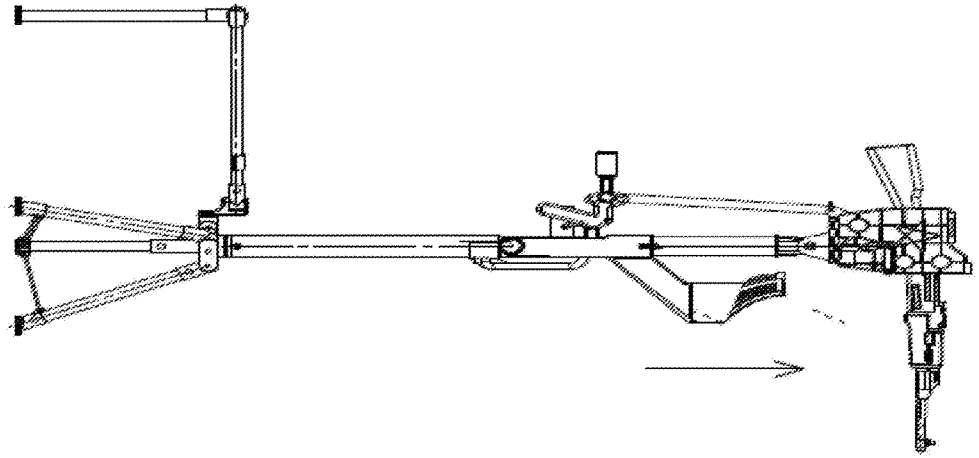
FIGS. 8A and 8B depict two positions of the reloading function of new magazines to the weapon of the mobile turret of the present invention.
Figure 8B:
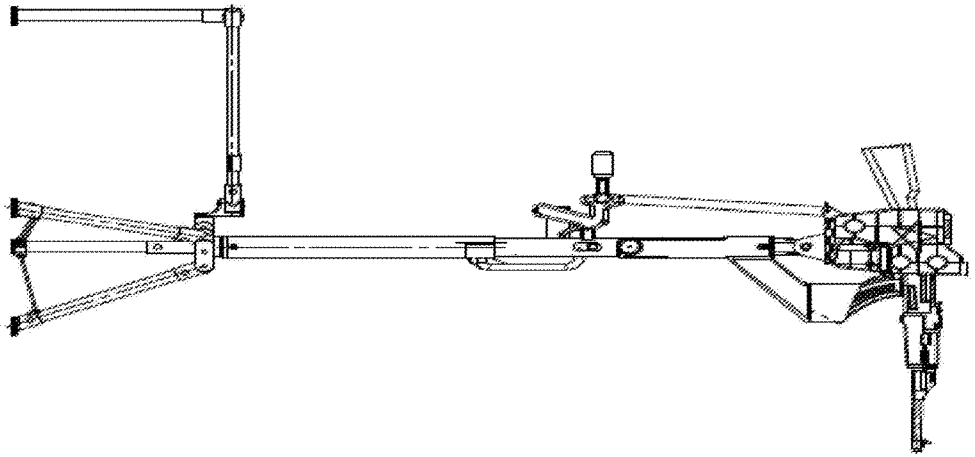

Yet according to another embodiment of the present invention, the second handle control is use to move the reload magazine slide up and down to load quickly new magazines to the weapon which increases weapon capacity to fire more rounds in a minute. The FIG. 8A and FIG. 8B depicts reloading function of new magazines to the weapon of the mobile turret of the present invention by the up-down movement of the reload magazine slide. The reload magazine slide is operated by the operator manually or in remote wireless operation a motor is added. The operator pushes up the reload magazine slide to reload the magazine in the weapon. The operators pull-down the reload magazine slide to bring back the reload magazine slide into its original position. The rod connector in the present invention press the magazine catch to release the empty magazine in the weapon and the reload magazine slide moved upward to reload the weapon. The empty magazine is removed thru a lever and it drops to the ground making way for the new loaded magazine.

Figure 9A:
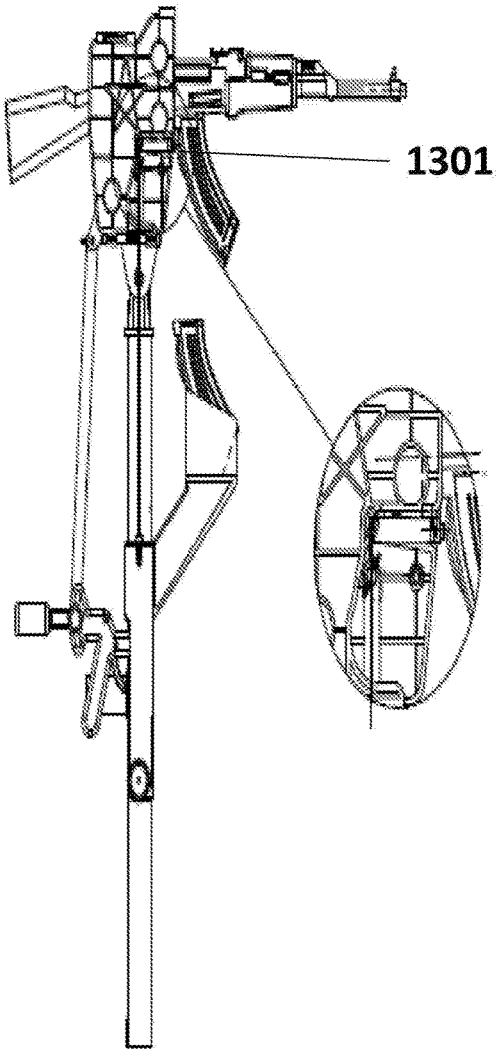
FIGS. 9A and 9B depict ejecting or removing magazines from the weapon of the mobile turret of the present invention.
Figure 9B:
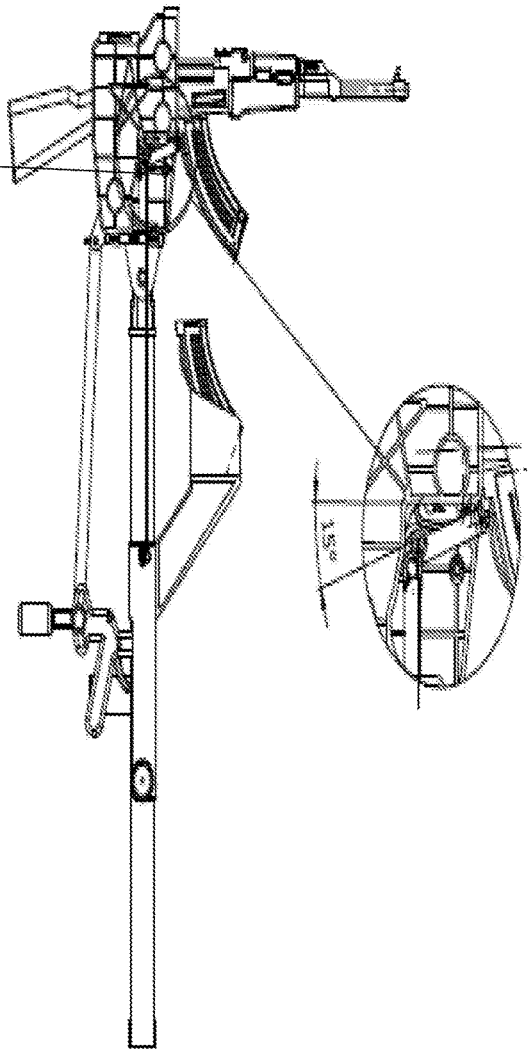

The FIG. 9A and FIG. 9B shows rejecting or removing magazines from the weapon of the mobile turret of the present invention. The rod connector is used to remove the empty magazine from the weapon by pressing the magazine catch of the weapon. When the rod connector is pushed by the second handle control in one end, the knob 1301 in another end of the rod connector press the magazine catch and the empty magazine release from the weapon.

Figures 10A, 10B:
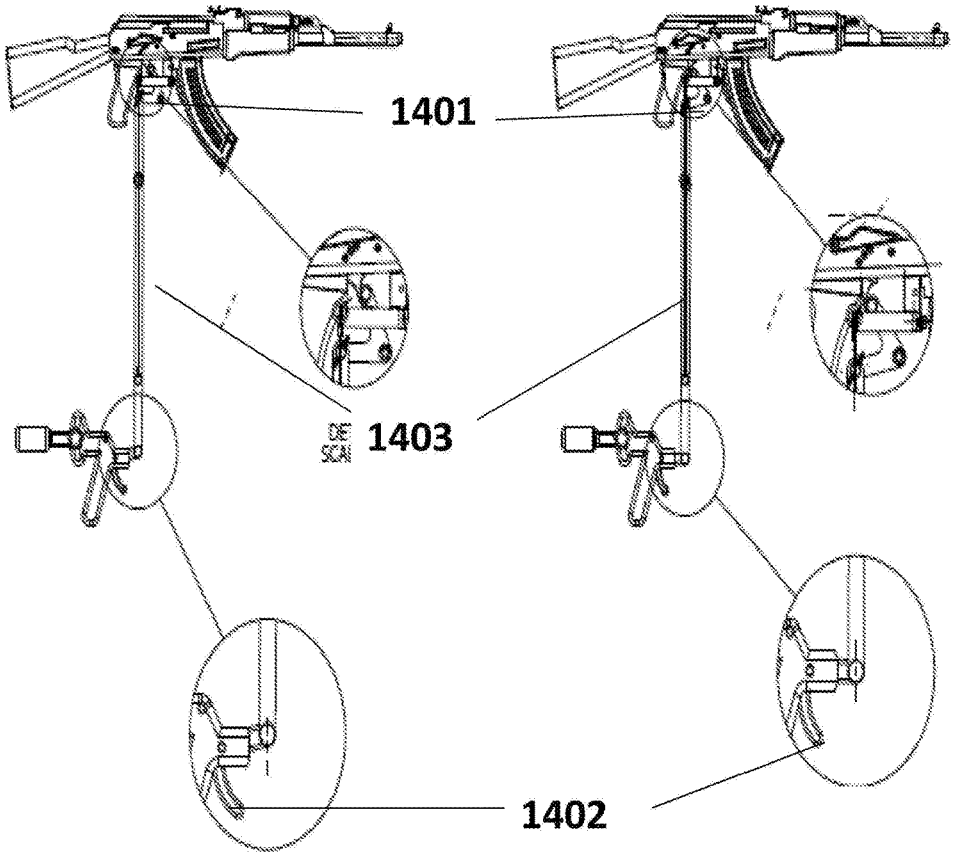
FIGS. 10A and 10B depict two arts of the trigger system of the mobile turret of the present invention.

According to one of the embodiments of the present invention has a triggering system in the mobile turret. Referring the FIG. 10A and FIG. 10B, this shows the different parts of the triggering system in the present invention. The triggering system in the present invention further comprise of plurality of lever 1403, plurality of handle, pin, rivet and trigger connector 1402. The pluralities of lever 1403 are connected between the trigger connector 1402 and the trigger 1401 of the weapon. A plurality of rivet and pin are used to tighten the connection of the plurality of lever 1403. The trigger connector 1402 at the bottom is connected to the trigger 1401 of the weapon at the top for firing. When the trigger connector 1402 at the bottom is pulled by the operator the trigger 1401 in the weapon also gets pulled and the weapon fires the bullet.

Figure 11:
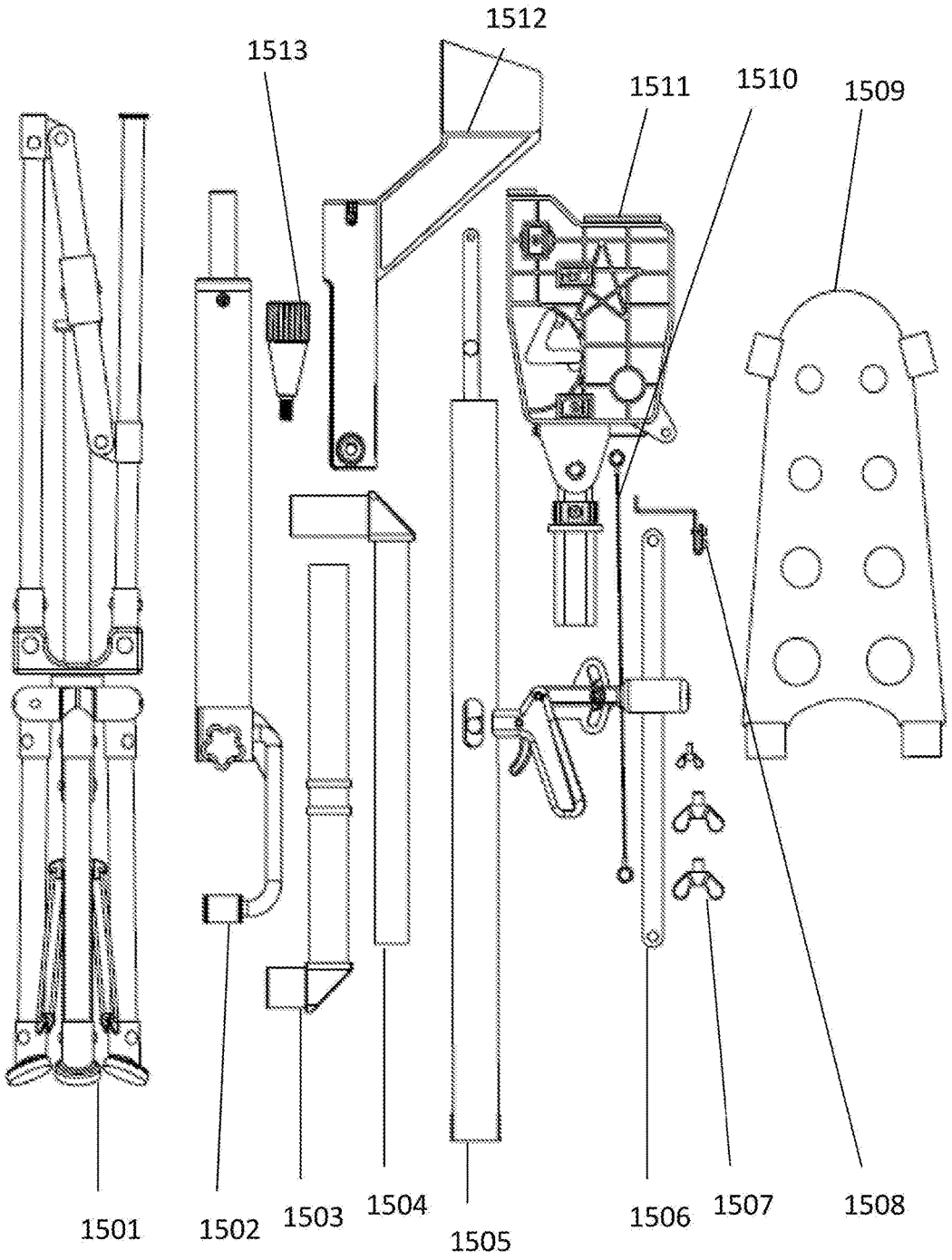
FIG. 11 depicts some of the elements or parts of the mobile turret of the present invention.

FIG. 11 shows some of the elements or parts of the mobile turret of the present invention. The first part in the FIG. 11 is the foldable base platform 1501 which is a base part of the mobile turret of the present invention. The periscope holder 1502 is connected with the level system-2. The expandable periscope in the present invention plays a major role in aiming the target. The expandable periscope in the present invention has two parts, one is movable part 1504 and another is fixed part 1503. The lever system-2 1505 is an integral part of collapsible turret arrangement. The lever system-2 1505 is movable and involves in regulating the height of the mobile turret. The trigger connector is connected to the trigger of the weapon through the lever 1506. For tightened all the connection a plurality of fasting screw 1507 are used in the present invention. The reject lever 1508 is used to reject the empty magazine from the weapon. The seat plate 1509 is connected in the foldable base part with the plurality of level through clip. The connector rod 1510 is connected between reselect lever and the second handle control. The function of the connector rod 1510 is to push the reject lever to reject the empty magazine. The holster 1511 is the topmost part in the present invention in which the weapon is fixed and the periscope is clamped. The reload magazine slide 1512 is use to reload the loaded magazine into the weapon. The reload magazine slide 1512 is the chamber or housing for loaded magazine. The first handle control 1513 uses to control the height of the mobile turret and the direction of the mobile turret.

Figure 12:
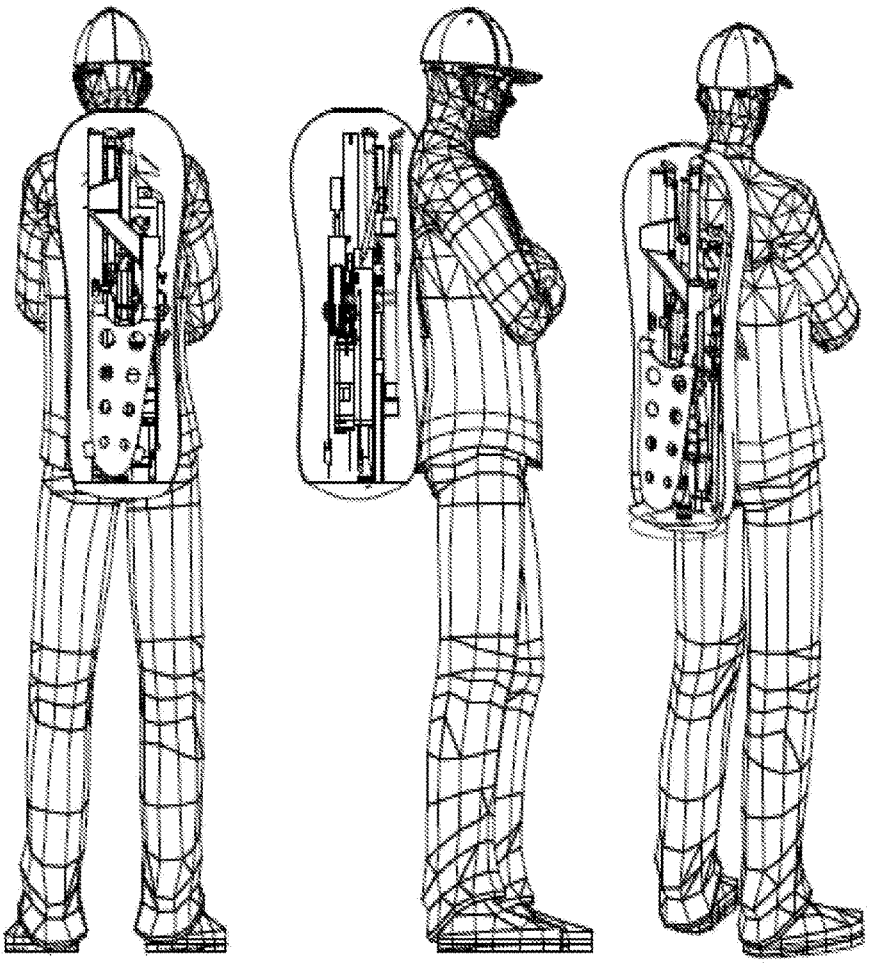
FIG. 12A-12C depicts a different view of the operator carrying the mobile turret of the present invention on shoulder like a back pack.
Figure 13:
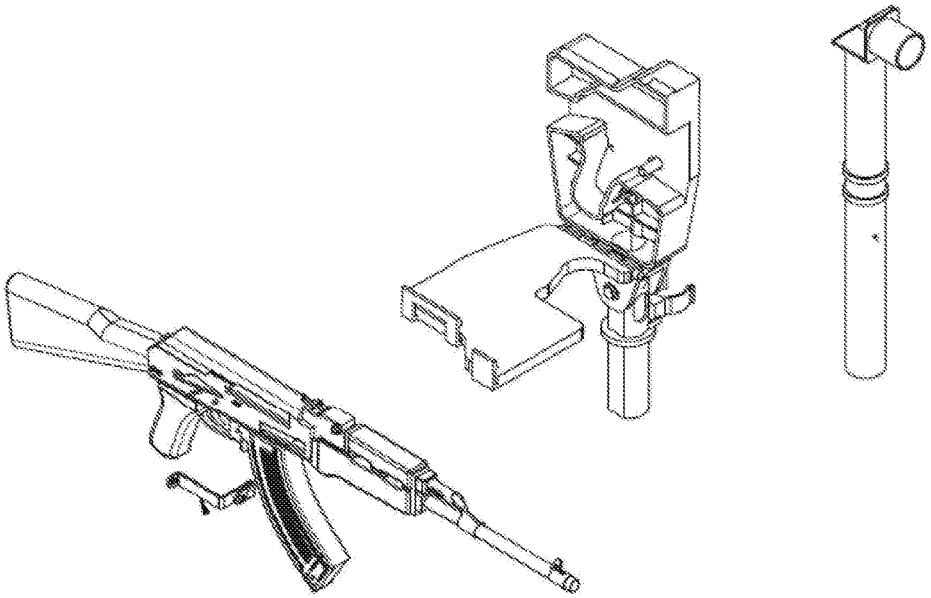

Yet another embodiment of the present invention, the mobile turret is foldable and collapsible and can be easily carried by the operator on the shoulder like backpack. In FIGS. 12A-12C it shows, a different view of the operator carrying the mobile turret of the present invention on shoulder like a back pack. The folded mobile turret is put on the backpack and carried to another place and unfolded to installed/configure the mobile turret and use it.

Figure 14:
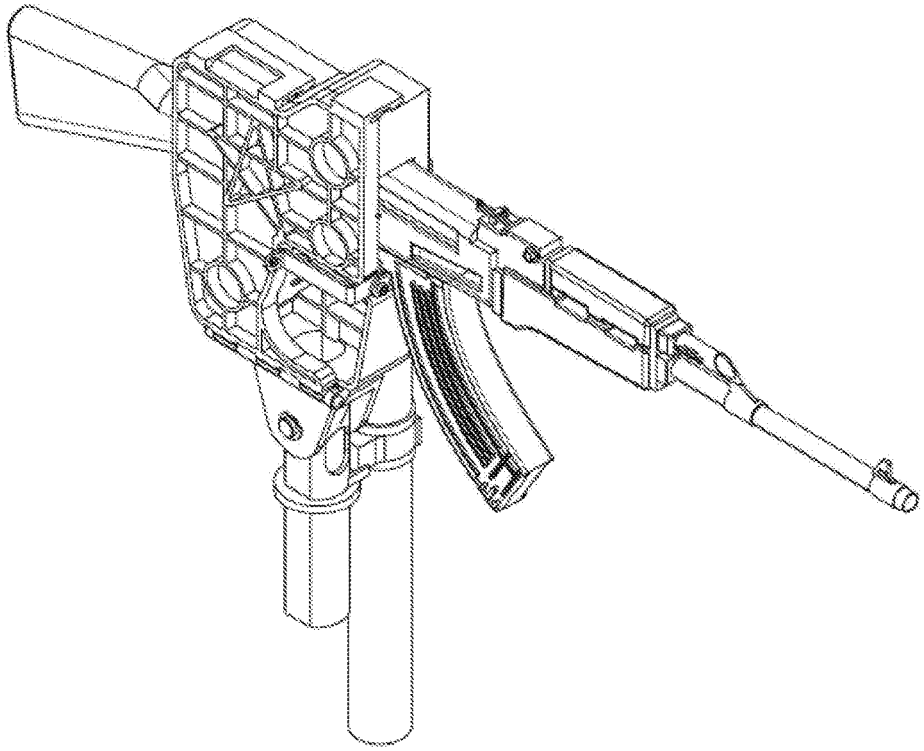
Figure 15A:
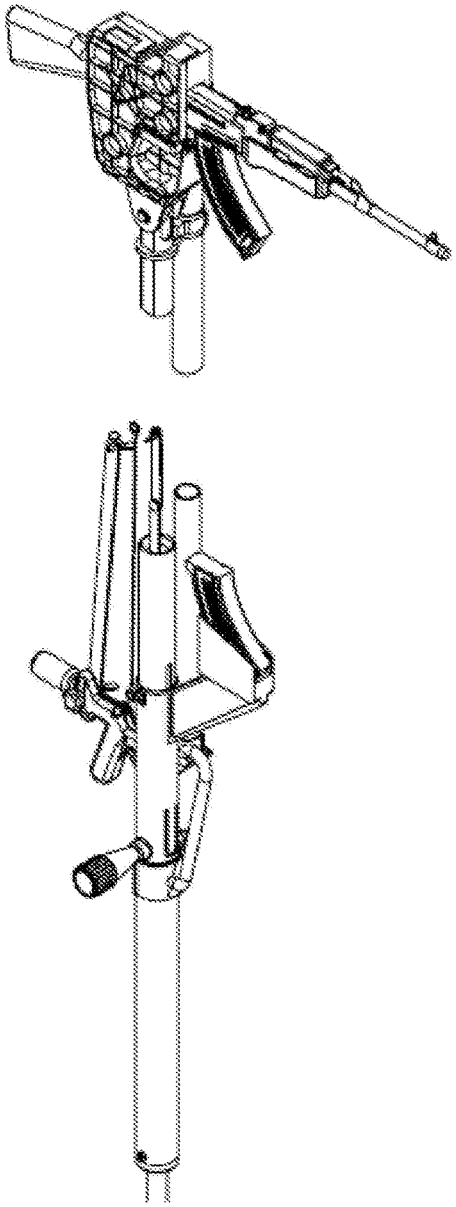
FIGS. 15A and 15B shows the holster of FIG. 14 in assembled and unassembled positions.
Figure 15B:
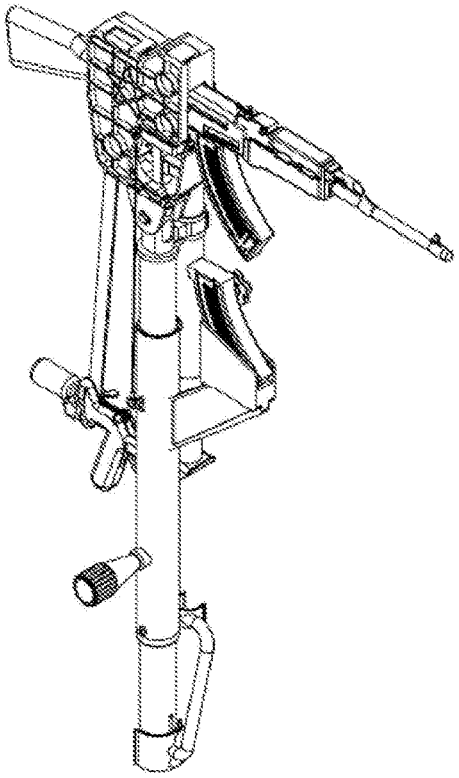
Figure 16A:
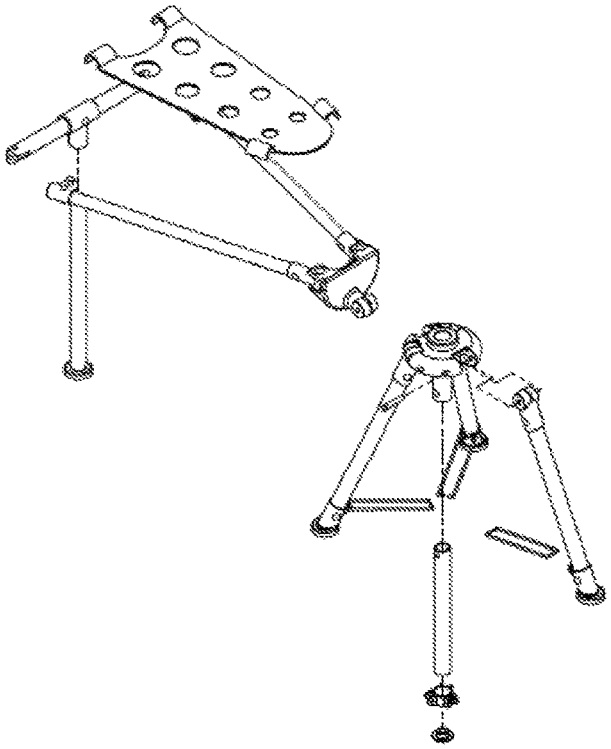
FIGS. 16A and 16B show an exploded and unexploded views of a foldable base platform having a seat and a tripod.
Figure 16B:
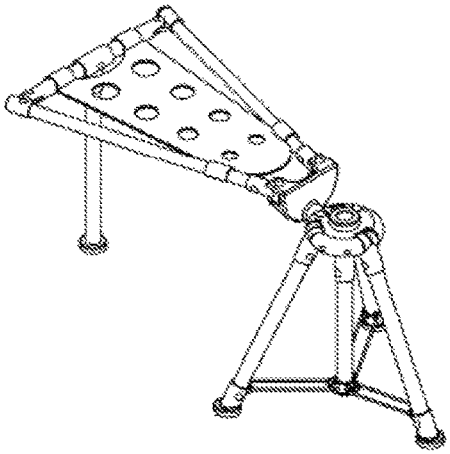
Figure 17A:
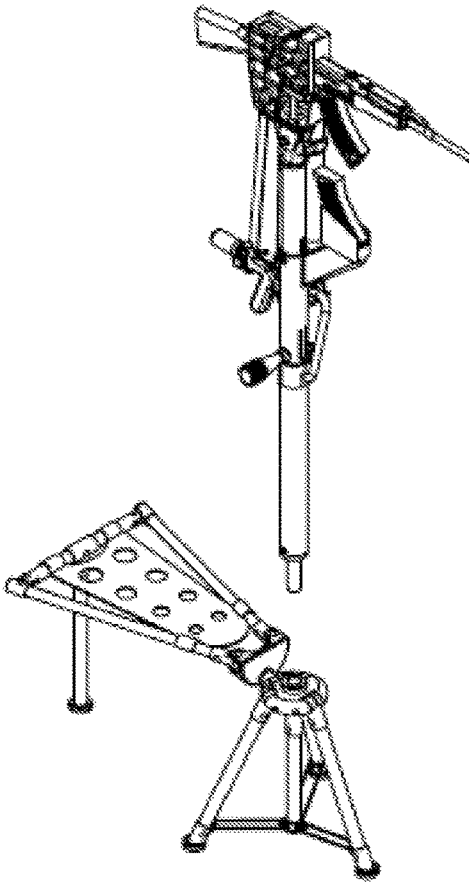
Figure 17B:
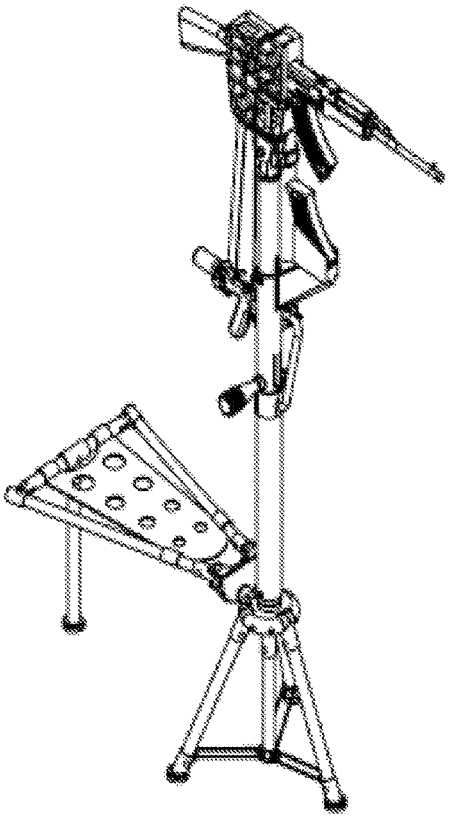

FIGS. 13 to 17B depicts arrangements of the mobile turret how each segment is connected with the other according to one of the embodiments of the present invention. In the FIG. 13 it shows the upper part of the mobile turret which comprise of the weapon, holster, expandable periscope and reject level. The expandable periscope is clamped in the holster and the weapon is clamped inside the weapon in the clamping gun system. The operator connects the reject level to the connector rod and the trigger connector connects to the trigger of the weapon. The FIG. 14 shows the holster in which all the part such as weapon, expandable periscope, reject level etc. is connected. The collapsible mobile turret comprise of plurality of level systems, such as level system-1 and level system-2, a first handle control, a second handle control, a rod connector, a trigger connector and a reload magazine slide, fastening screw-1, fastening screw2 and a level are shown in the FIGS. 15A and 15B. Plurality of rivets and pins are used to connect the all parts shown in the FIG. 15A-B. After tightening all the connections, the collapsible turret arrangement is connected to the upper part of the mobile turret i.e. the holster in the present invention. The foldable base platform shown in the FIG. 16 is further comprises of a seat and a tripod. The seat in the foldable base platform further comprise of plurality of levers, one back leg, seat plate, rivet and main base of the seat. The plurality of levers comprises of back part and right part and left part. One back leg is connected to support the seat. The seat plate is connected with the plurality of screws, pins, clamps. The pluralities of the parts are connected through the rivet and form a structure where the seat plate can be fixed by using a clip or snap in place clamping action. The main base part of the seat is act as connector between the seat and the tripod. The tripod in the foldable base platform further comprise of plurality of leg, tube slide, leg joints, rivets, main base, and plurality of pins. The pluralities of leg are connected in the main base by using rivet and connect each other through leg joint. The tube slide is connected at the center of the tripod which is fixed by plurality of pin and connector slide and the stopper. After tightening the entire rivet and the pin in the foldable base platform, the foldable base platform is ready to connect to the collapsible turret arrangement and the holster. The main base part of the tripod is connected to the main collapsible turret arrangement as shown in the FIG. 17A. The foldable base platform is connected to the collapsible turret arrangement and holster is connected on the collapsible turret arrangement. The FIG. 17B shows a fully arrange mobile turret which is ready to use for the operator.

Figure 18A:
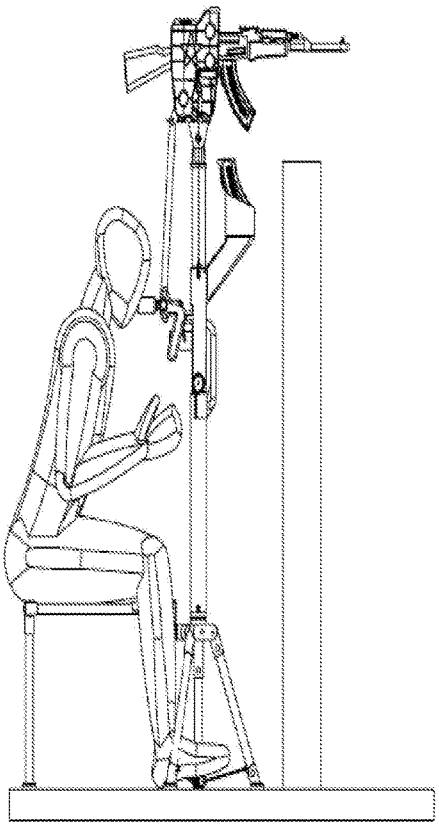
FIGS. 18A and 18B depict side and perspective views of the operator using the mobile turret of the present invention.
Figure 18B:
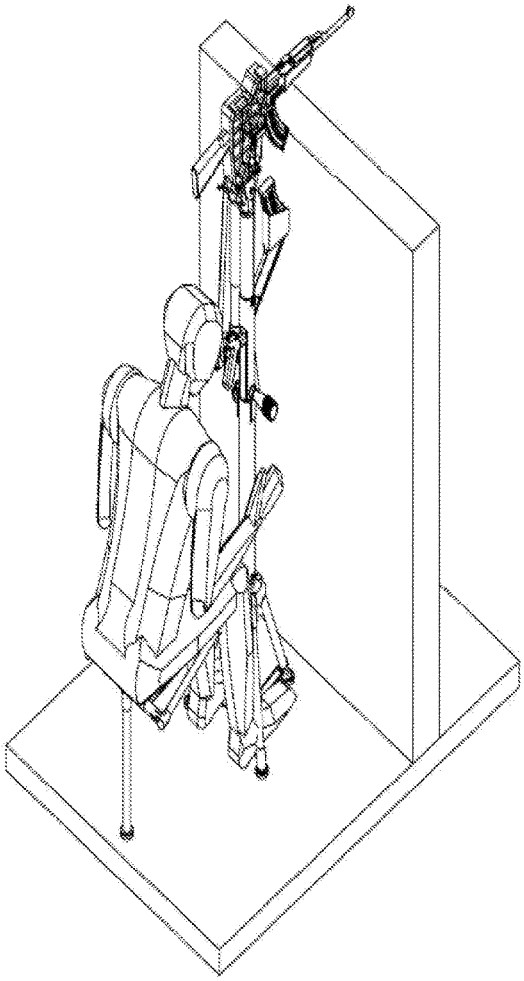

The FIGS. 18A and 18B shows a different view of the operator using the mobile turret of the present invention. The operator sits on the seat and sees the target through the periscope and fire on the target. The expandable periscope in the mobile turret can be used either in trenches or behind other protection to protect the operator from the enemy fire. The mobile turret is design in such a way that the operator can fire on the enemy by looking through a periscope. The operator can see the enemy and can adjust the weapon towards the target by watching through the expandable periscope and firing them. The expandable periscope has ranger finder which is calibrated with the laser of weapon to target enemy and the expandable periscope has display terrain, night vision and infrared. The height and the direction of the weapon and the expandable periscope can be adjusted by using the first handle control.

It is to be understood that the above description is intended to be illustrative, and not restrictive. For example, the above-discussed embodiments may be used in combination with each other. Many other embodiments will be apparent to those of skill in the art upon reviewing the above description.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the embodiments.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention.

What is claimed is:

1. A portable turret for supporting, aiming and firing a weapon, the portable turret comprising:

a base;

a vertical support rotatably supported by the base;

a weapon mounting fixture pivotably mounted on an upper end of the vertical support, the weapon mounting fixture adapted to receive and secure the weapon at an upper end of the vertical support;

a first handle adapted to rotate the vertical support relative to the base so as to adjust an azimuthal firing angle of the weapon;

a second handle attached to the vertical support forming a pistol grip and including a secondary trigger;

a trigger linkage extending between the secondary trigger and a primary trigger associated with the weapon such that a pulling movement of the secondary trigger mechanically causes a corresponding pulling movement of the primary trigger to fire the weapon;

an altitude firing angle adjustment lever associated with the second handle for adjusting the altitude firing angle of the weapon;

an altitude firing angle adjustment link extending between the altitude firing angle adjustment lever and a connection point on a rearward portion of the weapon mounting fixture such that upward and downward movement of the altitude firing angle adjustment lever causes the weapon mounting fixture to pivot forward and back atop the vertical support, thereby altering the altitude firing angle of the weapon secured within the weapon mounting fixture;

a magazine re-load lever associated with the weapon mounting fixture adapted to eject a spent magazine from the weapon secured within the weapon mounting fixture;

a magazine reload slide slidably attached to the vertical support, the magazine reload slide including a magazine compartment adapted to receive and hold an ammunition magazine, the magazine compartment oriented such that a magazine placed in the magazine compartment may be received by and loaded into the weapon by an upward sliding movement of the magazine reload slide; and a periscope mounted on the vertical support, the periscope having an image acquiring aperture substantially adjacent the weapon mounting fixture, an eyepiece substantially adjacent the second handle, and a telescoping optical tube extending therebetween.

2. The portable turret of claim 1 wherein the base comprises a collapsible tripod.

3. The portable turret of claim 2 further comprising a collapsible seat foldably attached to the tripod.

4. The portable turret of claim 1 wherein the weapon supported by the weapon mounting fixture is one of an automatic rifle; a semi-automatic rifle; a rocket launcher and a bazooka.

5. The portable turret of claim 1 wherein the periscope includes a range finder.

6. The portable turret of claim 1 further comprising a GPS system wirelessly linked to a command center.

7. A mobile turret allowing a soldier to fire a weapon from a protected firing position on a battle field, the mobile turret comprising:

a base;

a vertical support rotatably mounted to the base, the vertical support having an adjustable length and an upper end;

a weapon holster pivotably mounted on the upper end of the support, the weapon holster adapted to receive and support the weapon;

a secondary trigger lever attached to the vertical support between the base and the upper end of the vertical support;

a trigger linkage extending between the secondary trigger lever and a primary trigger associated with the weapon supported by the weapon holster, such that when the soldier pulls the secondary trigger, the trigger linkage mechanically pulls the primary trigger, thereby firing the weapon;

a first lever handle attached to the vertical support adapted to rotate the vertical support along with the weapon holster mounted thereon to adjust an azimuthal firing angle of the weapon; a second lever handle attached to the vertical support;

an altitude firing angle adjustment linkage connected between the second lever handle and the weapon holster, whereby upward and downward movement of the second lever handle causes the weapon holster to pivot forward and back atop vertical support to adjust the altitude firing angle of the weapon supported by the weapon holster;

a magazine ejection linkage allowing the soldier to remotely eject an ammunition magazine from the weapon;

a magazine reload slide slidably mounted on the vertical support, the magazine reload slide adapted to store a spare ammunition magazine for reloading the weapon, the magazine reload slide storing the spare magazine in a position such that the spare magazine may be loaded directly into the weapon by manually sliding the reload slide upward along the vertical support;

whereby the soldier may aim, fire and reload the weapon form a protected position below a firing position of the weapon supported by the weapon holster atop the vertical support.

8. The mobile turret of claim 7 wherein the base comprises a collapsible tripod.

9. The mobile turret of claim 8 further comprising a collapsible seat foldably mounted on the tripod base.

10. The mobile turret of claim 7 further including a pistol grip handle attached to the vertical support, the secondary trigger lever being located adjacent the pistol grip handle.

11. The mobile turret of claim 7 wherein the weapon comprises one of an automatic rifle; a semiautomatic rifle; a rocket launcher; and a bazooka.

12. The mobile turret of claim 7 further comprising a periscopic view finder for aiming the weapon, the periscopic view finder comprising an image receiving aperture mounted adjacent the weapon holster; an eyepiece mounted adjacent the vertical support; first and second diagonal mirrors and a telescoping optical tube mounted between the first and second diagonal mirrors.

13. The mobile turret of claim 12 wherein the periscopic view finder includes a range finder.

14. The mobile turret of claim 7 further comprising a GPS system wirelessly linked to a command center.

* * * * *